United States Patent [19]

Kuckhermann et al.

[11] Patent Number: 4,914,895

[45] Date of Patent: Apr. 10, 1990

[54] DEVICE FOR FILLING AND CLOSING SACKS, IN PARTICULAR PAPER SIDE FOLDING SACKS

[75] Inventors: Gustav Kuckhermann, Achern; Klaus Tolle, Sasbach; Eduard Turnwald, Durmersheim; Peter Zink, Kappelrodeck; Rainer Schäfer, Willstatt; Josef Hodapp, Kappelrodeck-Waldulm, all of Fed. Rep. of Germany

[73] Assignee: Icoma Packtechnik GmbH, Achern, Fed. Rep. of Germany

[21] Appl. No.: 192,557

[22] Filed: May 11, 1988

[30] Foreign Application Priority Data

May 11, 1987 [DE] Fed. Rep. of Germany ..... 3715702

[51] Int. Cl.[4] ..... B65B 43/26

[52] U.S. Cl. ..... 53/571; 53/384; 53/386; 53/573

[58] Field of Search ..... 53/571, 570, 573, 572, 53/384, 386, 468, 459

[56] References Cited

U.S. PATENT DOCUMENTS

| | | | |
|---|---|---|---|
| 3,053,027 | 9/1962 | Frost | 53/571 |
| 3,698,451 | 10/1972 | Hudson | 53/573 X |
| 3,715,858 | 2/1973 | Durant et al. | 53/573 |
| 3,859,062 | 1/1975 | Okubo et al. | 53/384 X |
| 4,198,800 | 4/1980 | Wilson | 53/452 |
| 4,423,583 | 1/1984 | Carey | 53/384 X |

FOREIGN PATENT DOCUMENTS

| | | |
|---|---|---|
| 483688 | 9/1929 | Fed. Rep. of Germany . |
| 7824437 | 8/1978 | Fed. Rep. of Germany . |
| 8518240 | 10/1985 | Fed. Rep. of Germany . |
| 353670 | 5/1961 | Switzerland . |

*Primary Examiner*—James F. Coan

*Attorney, Agent, or Firm*—Pollock, Vande Sande & Priddy

[57] ABSTRACT

An apparatus for filling and closing sacks or bags, in particular paper side folding sacks, has a plurality of processing stations including a filling station, stationary clamping elements for holding the sack in an open position and a slide cyclically movable between processing stations. Outside grippers are mounted on the slide which are designed to grasp an at least partially filled sack at its side folding by clamping the folding from the outside in said filling station and transporting the sack by means of the slide to the succeeding processing station.

15 Claims, 9 Drawing Sheets

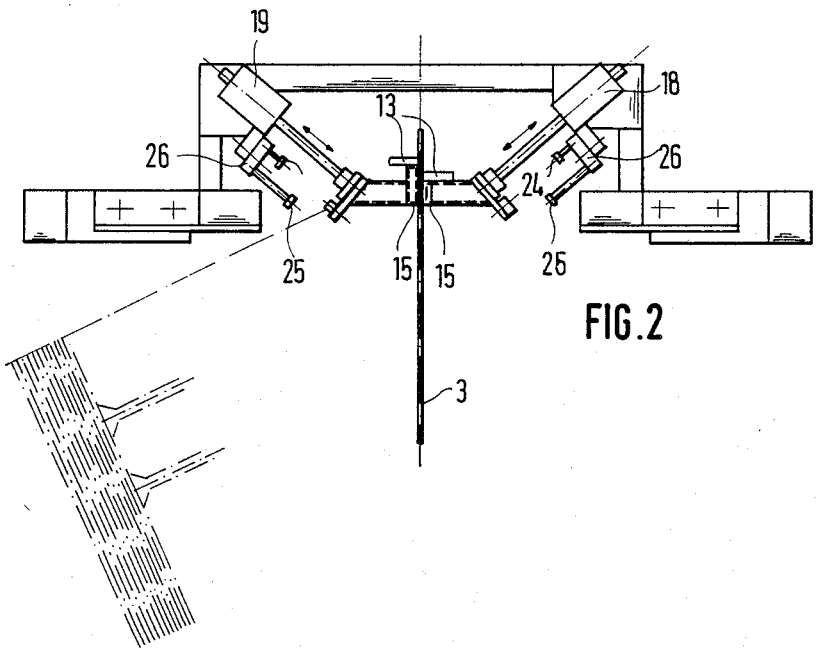
FIG.2
FIG.3
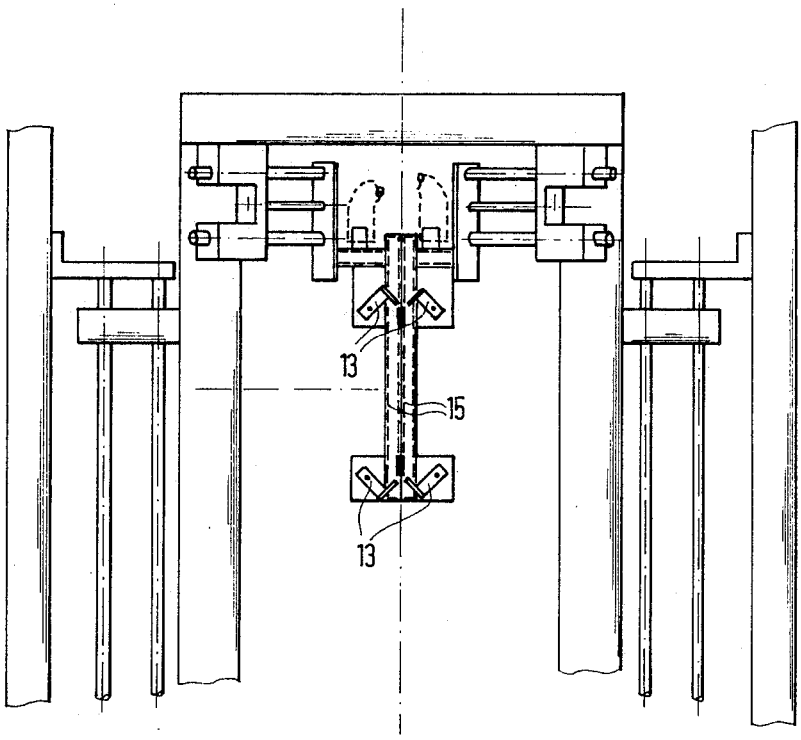

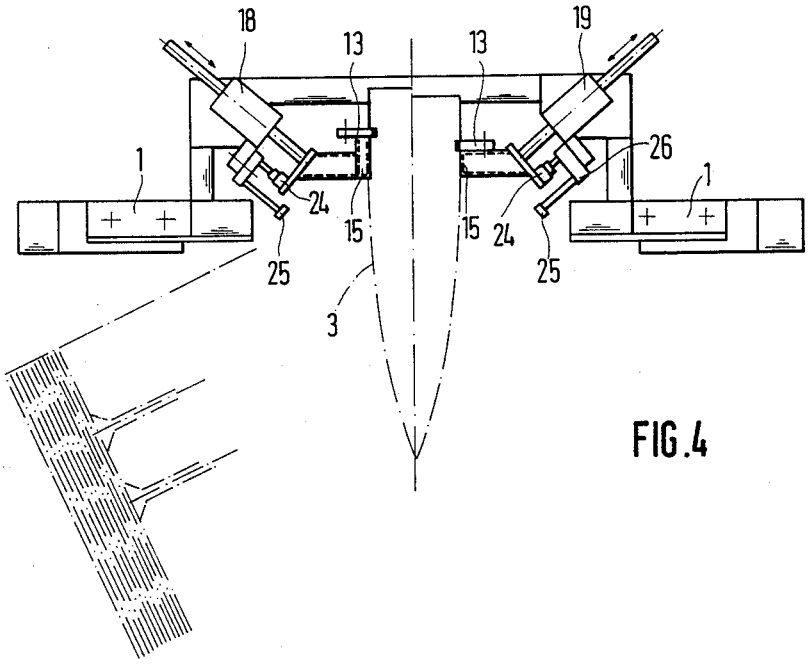
FIG.4
FIG.5
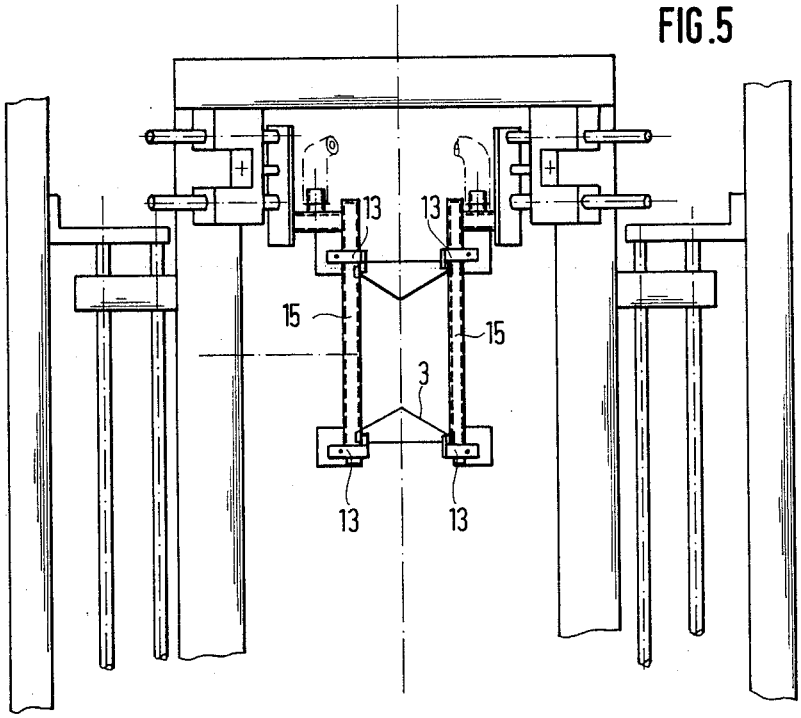

DEVICE FOR FILLING AND CLOSING SACKS, IN PARTICULAR PAPER SIDE FOLDING SACKS

BACKGROUND OF THE INVENTION

The present invention involves a device for filling and closing sacks or bags.

Known devices of this kind have the disadvantage that numerous operations such as for example, opening, filling, and closing; must be carried out at a single station. Filling stations of this kind often have the disadvantage that their operating speed is relatively low.

It is further known that in the so-called roto-packers the various operations are divided over several processing stations with the result that higher efficiency can be attained with such machines.

It is disadvantageous in the roto-packers that a change of format is very time-consuming and expensive on this kind of equipment.

SUMMARY OF THE INVENTION

To eliminate disadvantages of the prior art the invention has the task of designing a device of the type in which the change from one sack format to another is possible in a short time within a small space.

The provision of outside grippers, which grasp the sack in its side folds, permits the transport of the opened and filled or partially filled sacks to the next processing station without the sack having to be closed first. In this manner the filling process, for example, can be divided in such a way that the bulk of the commodity being loaded is poured in at the first filling station and if necessary is pre-compacted, while a precise topping off of the remaining quantity can take place at a second filling station. The provision of outside grippers, which in the present invention are moved with a slider that moves back and forth cyclically, thus permits a distribution of the operations that otherwise would have to done at one processing station over several individual stations arranged one after the other.

In comparison with known transport systems, such as for example conveyor belts gripping in the vicinity of the opening, the outside grippers in accordance with the present invention, which grasp by clamping the outside folds of the sacks, have the advantage that they allow to utilize the filling volume of the sack substantially better. In addition such outside grippers permit secure fixation and of the sacks transport in each desired defined position. This is also the case when in the three processing stations following one after the other, that is in the pre-opening station, the filling station and in the closing station, four outside grippers are provided, which take over the sack one after the other. In the present apparatus also invention various suction elements or suction strips are provided. Such suction elements or suction strips serve to open the sack in the pre-opening station and ensure that the outside folds of the pre-opened sack can be grasped through squeezing by the outside grippers. In the other stations suction strips that may be provided for supporting the holding effect.

The driving elements for separating or closing the outside grippers and/or the suction strips are preferably arranged at an acute angle deviating from the horizontal, which normally is set at 45°. This acute angle arrangement makes it possible to adapt the system very quickly to different sack formats. Because of the diagonal arrangement of the drive, the outside grippers and/or suction strips are not only moved further towards the center but at the same time further down, as is necessary during a change of format.

Through this it becomes possible to undertake the change in sack formats simply through providing for different adjusting paths on the driving elements. For example, different mechanical stops can be provided for the different sack formats or the adjusting set paths with special drives. It would be further possible to move mechanical stops into the desired position with servomotors. This would permit an automatic change of the sack formats.

In a preferred embodiment of the present invention the stops sit on a disc that can be rotated around an axis. Such an arrangement proves to be especially strong and reliable. If the stops are made in the form of adjustable screws, a fine adjustment of the stops can be undertaken if needed.

In accordance with a further feature the drive of the four fixed outside grippers in the closing station, in which the side folds are put in and the longitudinal walls are brought together, is coupled with the folding element that makes the side folds. Such a coupling by means of a connecting rod ensures that when there is a change in format the adjusting path of the folding elements is also adjusted.

Further it proves to be useful for a sealing station in which the plastic layer in the area of the fold line is bonded, when provision is made for a bondable plastic layer of the paper bag, to be placed after a closing station.

In this regard it is especially advantageous that welding dies are provided at the sealing station for sealing the sack in the upper side corner areas. The bonding of the welding dies in the upper corner area is optional. The result is that a side folding sack closed in this way assumes a shape very close to that of an ideal parallelepiped after the final closure.

In accordance with the present invention a second folding station for a second crimping is placed after the first folding station in which first crimping occurs.

Further features of the invention emerge from the following description in connection with the drawings.

Below a preferred embodiment of the present invention is explained in detail referring to the accompanying drawings, which show:

BRIEF DESCRIPTION OF THE DRAWINGS

FIG. 2 shows a schematic side view of the opening station when the sack is brought up closed, FIG. 3 shows a top view of the opening station in accordance with FIG. 2, FIG. 4 shows a side view analogous to FIG. 2 in the pre-opened position of the sack, FIG. 5 shows a top view of the pre-opening station in accordance with FIG. 4, FIG. 14 shows the arrangement in accordance with FIG. 10 with the side folding elements pushed in, FIG. 15 shows a representation in accordance with FIG. 11 with the side folding element pushed in.

DESCRIPTION OF THE PREFERRED EMBODIMENT(S)

Figure 1:
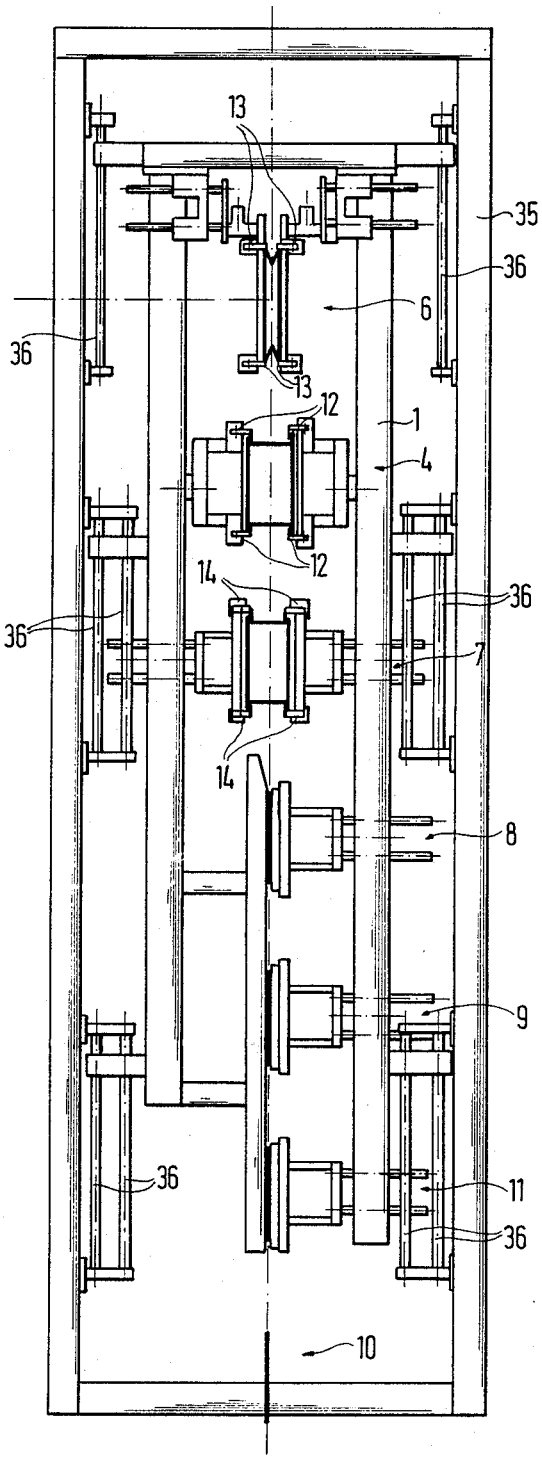
FIG. 1 shows a schematic top view of the device with various processing stations arranged one after the other.

As shown in FIG. 1, a machine frame 35 bears several guide tubes 36 placed on both sides and distributed over its length on which the guides of a slider, 1, are mounted so that they can be moved longitudinally. The device shown in FIG. 1 includes different stations, namely a pre-opening station 6, the adjacent filling 4 station and after it the closing station 7, which can also be designated as a topping off station and closing station. After closing station 7 follow a sealing station 8, a first folding station 9, further a reserve station 11, which is provided for installing handles, and finally a second folding station 10.

The construction of these various stations can be seen better from the following Figures.

In the pre-opening shown in FIGS. 2–5, station the individual sacks, which arrive in a package, are taken from the package by suction elements and placed between suction strips 15. The suction strips 15 are separated by means of the driving cylinders 18 and 19 and moved apart until they lie rest against one of the stops 24 and 25, which are arranged on two cylindrical discs. These stops 24 and 25 are in the form of screws and can be adjusted finely through turning them in one direction or the other to adjust their length. Depending on the sack format desired in each case the stop 24 or 25 is moved into position.

With the aid of the suction strips 15 the sack 3 is partially opened far enough that the outside grippers 13 can press the outer folds against the corresponding braces. The outside grippers are made in the form of swiveling grippers, which operate with an appropriate drive that is not shown in detail.

Figure 6:
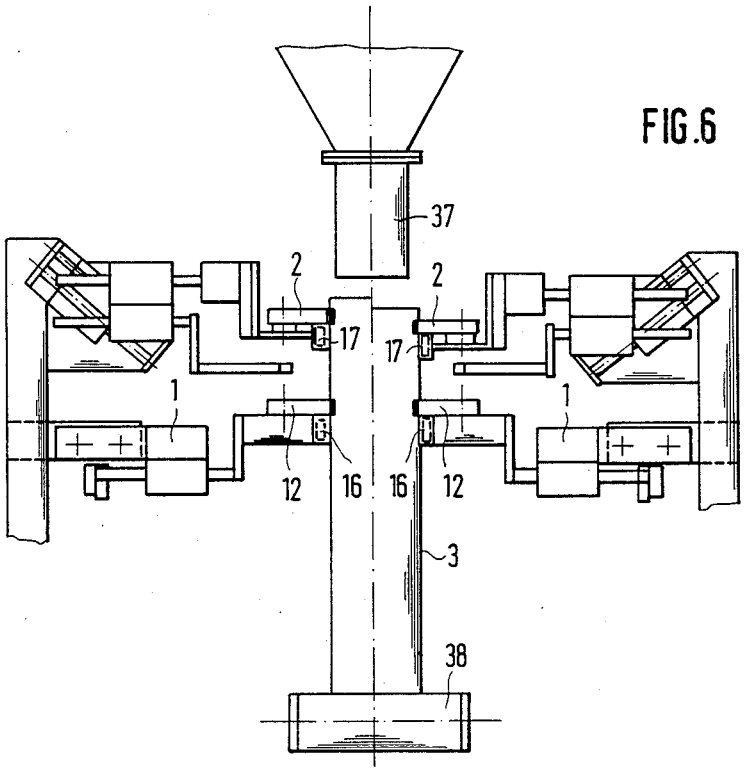
FIG. 6 shows a schematic side view of part of the filling station
Figure 7:
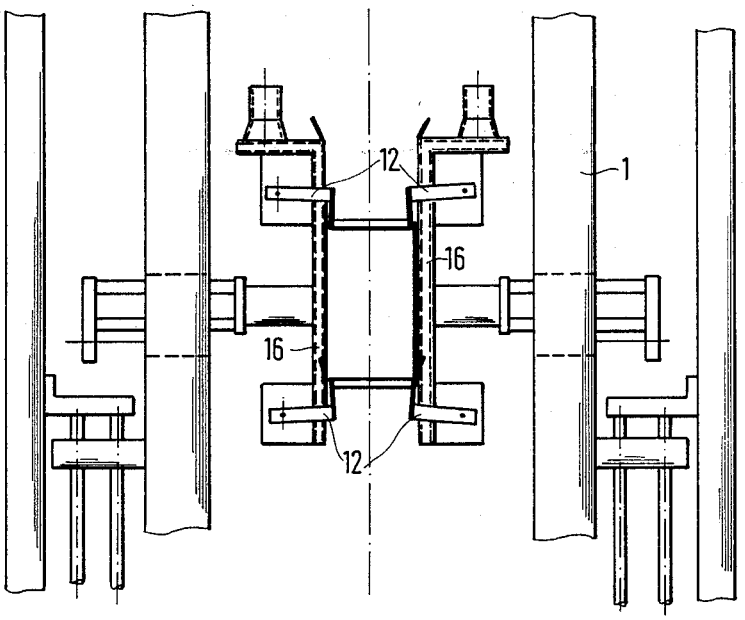
FIG. 7 shows a top view of the filling station with the filling spout removed.
Figure 10:
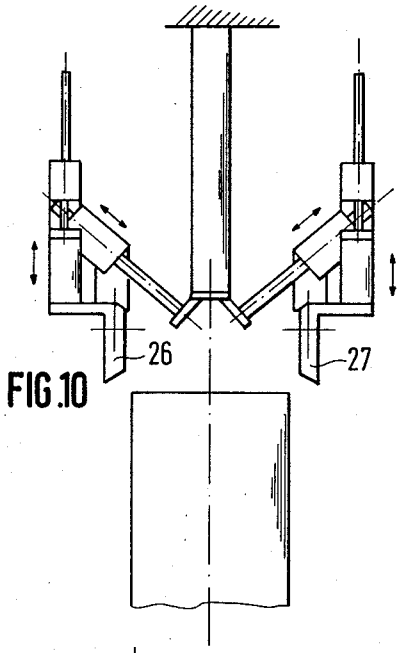
FIG. 10 shows a side view of the side folding elements in the closing station, seen perpendicular to the longitudinal direction of the machine.
Figure 11:
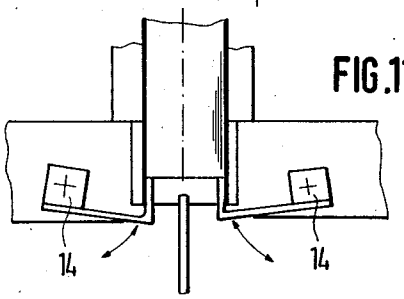
FIG. 11 shows a top view of two outside grippers of the closing station.
Figure 8:
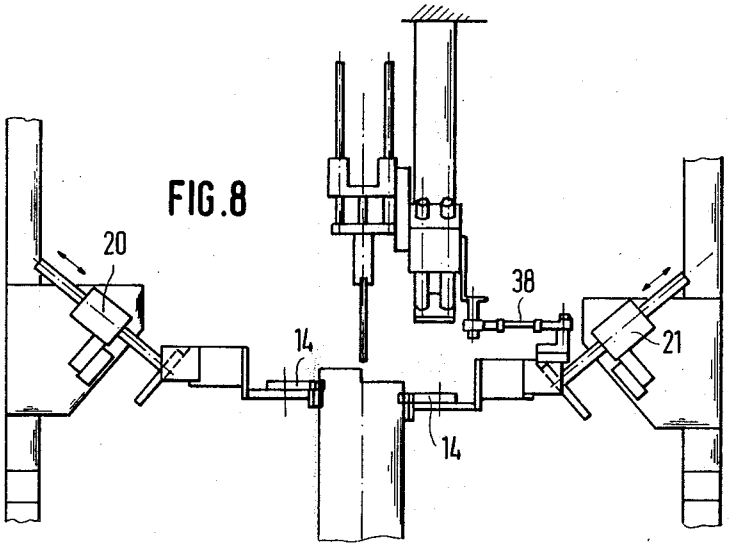
FIG. 8 shows a side view of the closing station seen in the longitudinal direction of the machine
Figure 9:
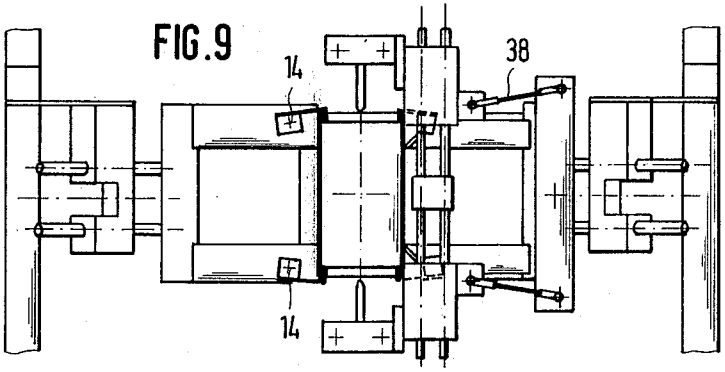
FIG. 9 shows a top view of the closing station.
Figure 14:
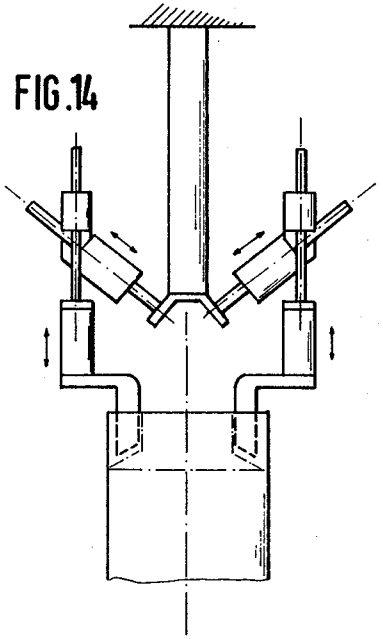
Figure 15:
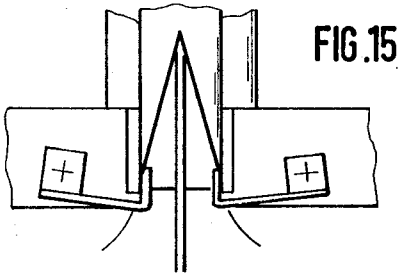
Figure 12:
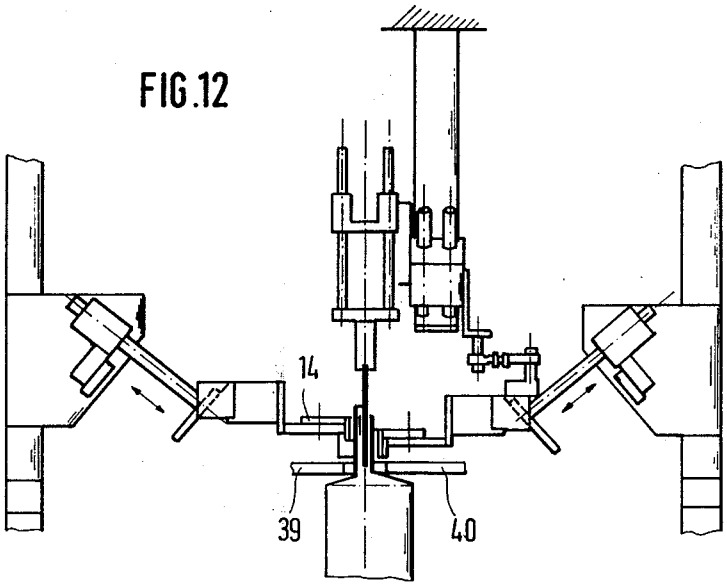
FIG. 12 shows a side view of the closing station in a partially closed position.
Figure 13:
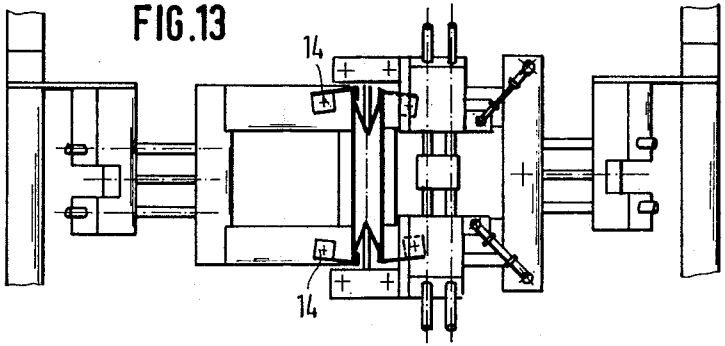
FIG. 13 shows a top view similar to FIG. 9 in a partially closed position of the side folding sack.
Figure 16:
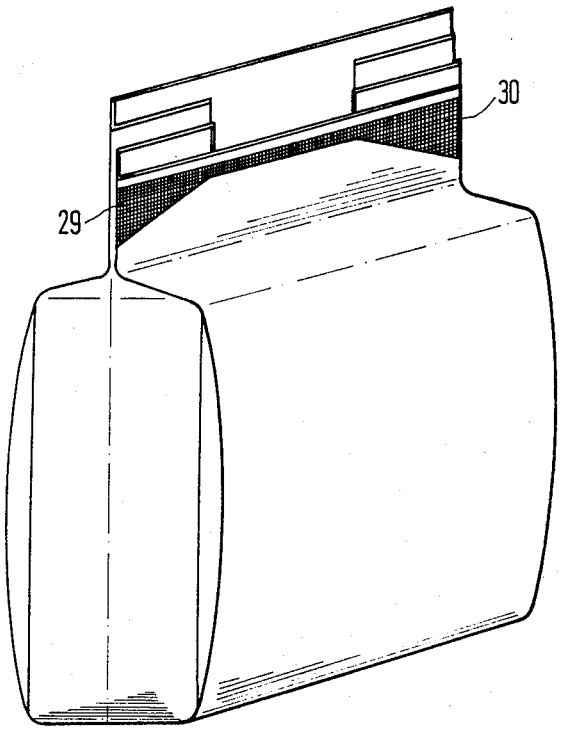
FIG. 16 shows a perspective view of a side fold sack with the corner areas bonded.
Figure 17:
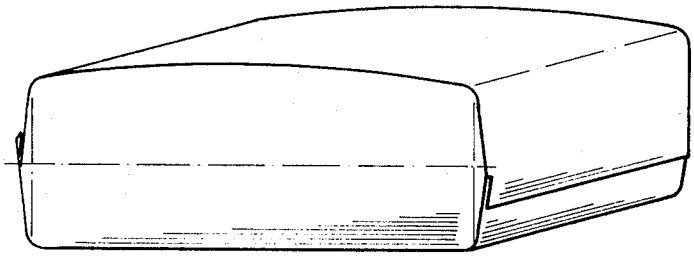
FIG. 17 shows a perspective view of the filled and closed sack.
Figure 19:
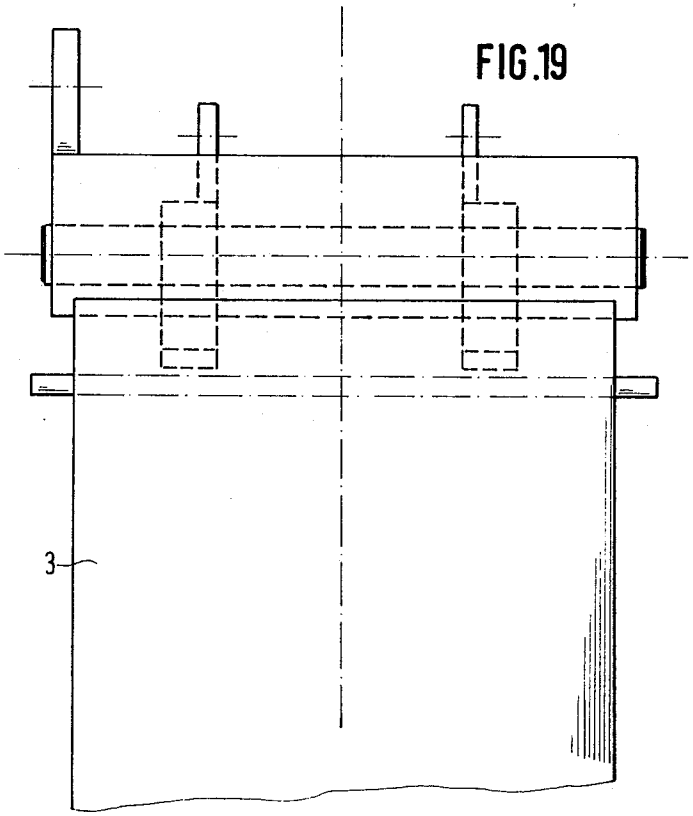
FIG. 19 shows the double fold station in accordance with FIG. 18 in a side view perpendicular to the first view.
Figure 18:
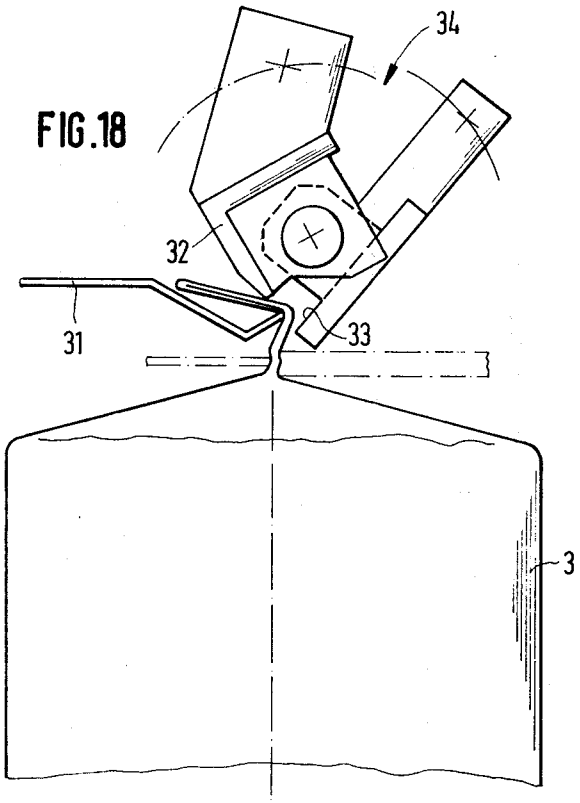
FIG. 18 shows a double fold device in a first position in a first side view.

The pre-opened sack 3 is moved by means of the slide 1 into the filling station 4 shown in FIGS. 6–7 under the fixed filling funnel 37. The pre-opened sack is then gripped by the stationary gripper 2, which can also be swivelled and is linked with the two suction bars, that can be moved towards each other and away from each other. During the filling process the sack lies on the sack rest 38. During the filling process the slide 1 can move back to the pre-opening station to pick up a new sack. As the grippers 12 that are mounted on the slide 1 move back out of the sealing station they assume the acceptance position shown in FIGS. 6 and 7 in which they grasp the filled sack 3 by squeezing. The fixed grippers 2 are released and with the next operating cycle the slide conveys the filled sack 3 by means of the gripper 12 from the filling station to the sealing station 7.

In the sealing station both fixed outside grippers 14 and fixed folding elements 26 and 27 are provided.

When the drive cylinders 20 and 21 are moved the folding elements 26 and 27 are carried along by means of a connecting rod 38. When the folding elements 26 and 27 come together to close the sack (see FIGS. 12–15), they put in the side folds. As soon as the folding position shown in FIGS. 12 to 15 is attained by means of the outside grippers 14 and the folding elements 26 or 27, two compression strips 39 and 40 firmly squeeze the almost completely folded sack. The compression strips 39 and 40 are mounted on the slide 1 and transport the firmly clamped with the next cycle further to the sealing station. In the sealing station, in the first folding station and in the second folding station compression strips, whose drive is not in detail, are provided as in the reserve station to undertake in each case the onward transport of the processed sack.

In the sealing station 8 sealing of the sack along the upper fold line takes place. In the process it is possible that through an appropriate configuration of the welding dies bonding of the corner areas 29 and 30 also occurs.

In the following folding station the first crimping, which is made in the known way and therefore is not described further, takes place. In the second folding station double folding is carried out.

This takes place with the aid of the folding blade 31, which moves perpendicularly to the longitudinal motion and conveys the sack above the compression strips between the jaws 32 and 33 of a folding tongs designated as 34.

Figure 21:
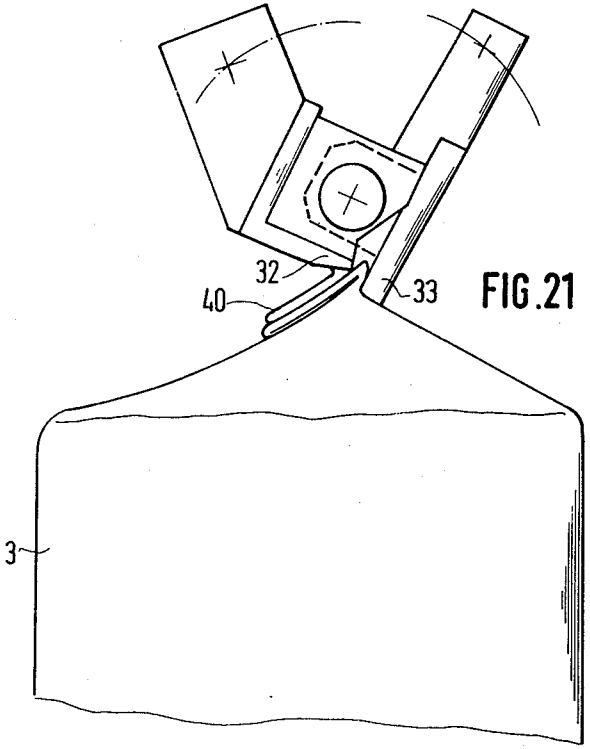
FIG. 21 shows the double fold station in the last operating phase.
Figure 20:
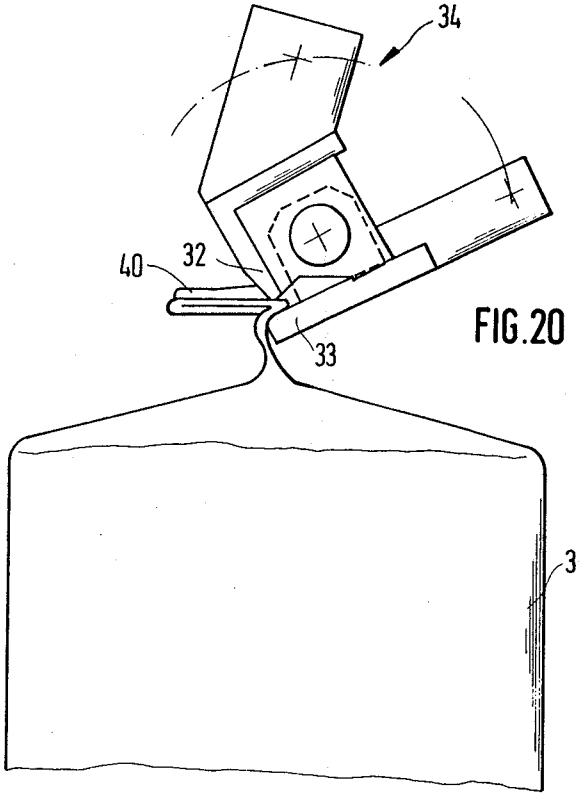
FIG. 20 shows the double fold station in a further operating phase.

Afterwards the sack area that was thus grasped is pressed onto the sack area lying below through swiveling the whole folding tongs (see FIG. 34) by means of the thrust member 40, which is shown in FIGS. 21 and 22 and sits on the folding jaws. A firm bonding of the double folded sack 3 in the position shown in FIG. 21 occurs through the adhesive that has been previously spread on the appropriate places.

In the description above the expression "fixed" is used in the sense meaning that the parts so designated do not move with the slide. The parts designated as "fixed," however, are not stationary but can indeed be moved.

We claim:

1. An apparatus for filling and closing sacks or bags, in particular paper side folding sacks, having a plurality of processing stations positioned at a distance from each other and including a filling station in which a weighed quantity of the goods to be filled can be poured out of a bin into a sack, said apparatus comprising stationary clamping elements for holding said sack in an open position, a slide movable cyclically between two successive processing stations, and outside grippers mounted on said slide for grasping at least the partially filled sack at its side folding by clamping said folding from the outside in said filling station and transporting said sack by means of said slide to a subsequent processing station.

2. An apparatus in accordance with claim 1, comprising four outside grippers in at least two sets, each set provided on said slide at intervals corresponding to the distance between succeeding processing stations.

3. An apparatus in accordance with claim 2, further including suction elements for opening the initially closed sack, said suction elements being provided in a first processing station positioned before said filling station to which the empty sacks are brought.

4. An apparatus in accordance with claim 3, wherein said suction elements are suction strips mounted in parallel to the direction of transportation of said sacks.

5. An apparatus in accordance with claim 3, wherein said stationary clamping elements provided in said filling station are four stationary outside grippers.

6. An apparatus in accordance with claim 1, wherein said slide is provided with four outside grippers and suction strips at intervals corresponding to a distance between succeeding processing stations.

7. An apparatus in accordance with claim 6, further comprising drive elements for separating and bringing together said outside grippers and said suction strips, wherein said drive elements are arranged at an acute angle from the horizontal.

8. An apparatus in accordance with claim 7, including stops corresponding to different sack formats for adjusting paths of said drive elements thereby adjusting the format of said processing stations.

9. An apparatus in accordance with claim 8, wherein said stops are provided on a disk which is rotatable around an axis.

10. An apparatus in accordance with claim 9, wherein in a closing station for providing side folds and putting together longitudinal walls, a drive for four stationary outside grippers is coupled with a drive for folding elements.

11. An apparatus in accordance with claim 10, wherein said folding elements are linked through a connecting rod with said drive for clamping elements in such a way that a format change in said drive is linked with a corresponding adaptation of the adjusting path of said folding elements.

12. An apparatus in accordance with claim 11, wherein a sealing station, in which the plastic layer in the area of the fold line is sealed, when a plastic layer of the paper sack that can be bonded is provided, is installed after a closing station.

13. An apparatus in accordance with claim 12, further comprising welding dies for holding said sack in the upper side corners, said dies being provided at said sealing station.

14. An apparatus in accordance with claim 13, further including a second folding station installed after a first folding station for providing a second crimping.

15. An apparatus in accordance with claim 14, wherein said second folding station includes a folding blade movable perpendicularly to said sack and designed to push the pre-folded sack between the jaws of folding tongs, said jaws being adjusted to swing against each other, said folding tongs being swingable to press the sack area that is grasped against the adjacent sack area lying underneath.

* * * * *